US008876314B2

(12) United States Patent
Zhu et al.

(10) Patent No.: US 8,876,314 B2
(45) Date of Patent: Nov. 4, 2014

(54) DRAWER-TYPE REFRIGERATOR WITH A LIGHTING DEVICE

(75) Inventors: Tao Zhu, Hefei (CN); Lingyun Li, Hefei (CN); Jian Cheng, Hefei (CN); Haixing Zhang, Hefei (CN); Fang Zhao, Hefei (CN)

(73) Assignees: Hefei Midea Rongshida Refrigerator Co., Ltd. (CN); Hefei Hauling Co., Ltd. (CN)

( * ) Notice: Subject to any disclaimer, the term of this patent is extended or adjusted under 35 U.S.C. 154(b) by 186 days.

(21) Appl. No.: 13/512,487

(22) PCT Filed: Oct. 11, 2010

(86) PCT No.: PCT/CN2010/077647

§ 371 (c)(1), (2), (4) Date: May 29, 2012

(87) PCT Pub. No.: WO2012/000245

PCT Pub. Date: Jan. 5, 2012

(65) Prior Publication Data

US 2012/0230015 A1 Sep. 13, 2012

(30) Foreign Application Priority Data

| | | |
|---|---|---|
| Jun. 28, 2010 | (CN) | 2010 1 0213003 |
| Jun. 28, 2010 | (CN) | 2010 1 0213021 |
| Jun. 28, 2010 | (CN) | 2010 1 0213022 |
| Jun. 28, 2010 | (CN) | 2010 1 0213036 |

(51) Int. Cl.

| | |
|---|---|
| ***F21V 33/00*** | (2006.01) |
| ***F25D 27/00*** | (2006.01) |
| *F25D 25/02* | (2006.01) |

(52) U.S. Cl.

CPC ..... *F25D 27/00* (2013.01); *F25D 25/025* (2013.01)

USPC ..... 362/92; 62/264; 99/451; 362/249.02; 362/249.12

(58) Field of Classification Search

USPC ..... 362/92, 94, 133, 155, 249.01, 249.02, 362/249.05, 249.12, 264, 276, 295, 394, 362/800, 802; 62/126, 131, 264; 99/451

See application file for complete search history.

(56) References Cited

U.S. PATENT DOCUMENTS 2,667,323 A * 1/1954 Mason ..... 248/298.1

(Continued)

FOREIGN PATENT DOCUMENTS

| | | |
|---|---|---|
| CN | 2747524 Y | 12/2005 |
| CN | 2861901 Y | 1/2007 |

(Continued)

OTHER PUBLICATIONS

International Search Report for Application No. PCT/CN2010/077647 dated Apr. 7, 2011.

*Primary Examiner* — Hargobind S Sawhney

(74) *Attorney, Agent, or Firm* — Lerner, David, Littenberg, Krumholz & Mentlik, LLP

(57) ABSTRACT

A lighting device for a drawer type refrigerator is provided. The drawer type refrigerator comprises at least one drawer having a drawer door, and an upper rotary door or an upper drawer door disposed above the drawer door. The lighting device comprises: a lamp assembly comprising a lamp and a lamp shade of a light-transmission material and disposed in a groove formed in a lower portion of the upper rotary door or the upper drawer door; a switch assembly configured to control the lamp assembly based upon whether the drawer is pulled out; a power supply assembly configured to supply power to the switch assembly; and a connection assembly connected between the lamp assembly and the switch assembly to supply power to the lamp assembly.

15 Claims, 8 Drawing Sheets

(56) References Cited

U.S. PATENT DOCUMENTS

| | | | | | |
|---|---|---|---|---|---|
| 5,032,957 | A * | 7/1991 | Canfield | 362/133 |
| 5,535,960 | A * | 7/1996 | Skowronski et al. | 242/378.4 |
| 7,685,934 | B2 * | 3/2010 | Min et al. | 99/451 |
| 8,327,657 | B2 * | 12/2012 | Min et al. | 62/264 |
| 2011/0162402 | A1 * | 7/2011 | Park | 62/264 |

FOREIGN PATENT DOCUMENTS

| | | | | | |
|---|---|---|---|---|---|
| CN | 101846429 | A | | 9/2010 | |
| CN | 101949627 | A | | 1/2011 | |
| JP | 09028363 | A | * | 2/1997 | A23L 3/36 |
| JP | 10300338 | A | | 11/1998 | |
| JP | 2007218582 | A | | 8/2007 | |
| WO | 2009103458 | A2 | | 8/2009 | |

* cited by examiner

DRAWER-TYPE REFRIGERATOR WITH A LIGHTING DEVICE

CROSS REFERENCE TO RELATED APPLICATIONS

The present application is a national phase entry under 35 U.S.C. §371 of International Application No. PCT/CN2010/077647 filed Oct. 11, 2010, published in Chinese, which claims priority from Chinese Patent Application No. 201010213021.3 filed Jun. 28, 2010, Chinese Patent Application No. 201010213022.8 filed Jun. 28, 2010, Chinese Patent Application No. 201010213036.X filed Jun. 28, 2010 and Chinese Patent Application No. 201010213003.5 filed Jun. 28, 2010, all of which are incorporated herein by reference.

FIELD

The present disclosure generally relate to the field of refrigeration apparatus design and manufacturing, more particularly, to a lighting device for a drawer type refrigerator.

BACKGROUND

With the improvement of human living standard, there are increased requirements for functions of a refrigeration apparatus such as a refrigerator. Therefore, a high-end multifunctional refrigerator needs to be developed. In order to facilitate refreshing of food, a high-end drawer type refrigerator is proposed. Because a cabinet of the drawer type refrigerator has no moving components, presently, layout, mounting and reliability of a lamp assembly may be easily realized. Therefore, the lamp assembly is disposed in a cabinet of a conventional drawer type refrigerator. FIG. 1 is a schematic view showing the position of a lamp assembly in a conventional drawer type refrigerator. As shown in FIG. 1, the lamp assembly 1' is disposed in a cabinet 2' in which a drawer 3' is placed.

The conventional drawer type refrigerator has the following defects. As shown in FIG. 2, when the drawer 3' is pulled out, because the lamp assembly 1' is disposed within the cabinet 2', the food in the drawer 3' will be pulled out with the drawer 3', such that the food in the drawer 3' may not be effectively lighted by the lamp assembly 1'. In addition, because light is blocked by the food in the drawer 3', the lighting effect of the lamp assembly 1' in the cabinet 2' may be nearly neglected.

SUMMARY

The present disclosure seek to solve at least one of the problems existing in the prior art to at least some extent, particularly to solve a problem of poor lighting effect of a lamp assembly in a drawer type refrigerator.

According to embodiments of a first broad aspect of the present disclosure, there is provided a lighting device for a drawer type refrigerator. The drawer type refrigerator comprises at least one drawer having a drawer door, and an upper rotary door or an upper drawer door disposed above the drawer door. The lighting device comprises: a lamp assembly comprising a lamp and a lamp shade of a light-transmission material and disposed in a groove formed in a lower portion of the upper rotary door or the upper drawer door; a switch assembly configured to control the lamp assembly based upon whether the drawer is pulled out; a power supply assembly configured to supply power to the switch assembly; and a connection assembly connected between the lamp assembly and the switch assembly to supply power to the lamp assembly.

In one embodiment, the lamp has a predetermined inclination angle to emit light obliquely toward an outside of the drawer type refrigerator.

In one embodiment, an outer surface of the lamp shade is flush with an opening of the groove.

In one embodiment, the switch assembly comprises: a detecting unit configured to detect whether the drawer door is pulled out; and a main control board configured to control the lamp assembly in the upper rotary door or the upper drawer door based on a detecting result of the detecting unit.

In one embodiment, if the upper rotary door is disposed above the drawer door, the connection assembly comprises: a connection line passing through a hollow rotation shaft of the upper rotary door and defining a first end connected to the switch assembly and a second end connected to the lamp assembly.

In one embodiment, if the upper drawer door is disposed above the drawer door, the connection assembly comprises: a first coil disposed on an inner side wall of a cabinet of the drawer type refrigerator and connected to the switch assembly; and a second coil disposed on a side wall of an upper drawer, opposite to the first coil, and connected to the lamp assembly.

In one embodiment, the connection assembly further comprises: a first processing circuit connected to the power supply assembly and the first coil respectively and configured to convert a current of the power supply assembly into a high-frequency alternating current; and a second processing circuit connected to the second coil and configured to convert an alternating current generated by induction of the second coil into a direct current and supply the direct current to the lamp assembly.

In one embodiment, the power supply assembly comprises an industrial frequency alternating current power supply for supplying power to the drawer type refrigerator, and the first processing circuit comprises a full-bridge rectifier circuit and an inverter circuit connected to the full-bridge rectifier circuit.

In one embodiment, the power supply assembly comprises a main control board for supplying a direct current, and the first processing circuit comprises an inverter circuit.

In one embodiment, the second processing circuit comprises a full-bridge rectifier circuit.

In one embodiment, if the upper drawer door is disposed above the drawer door, the connection assembly comprises: a connection line connected to the switch assembly and the lamp assembly respectively; and a wire take-up unit around which a part of the connection line is wound and which applies a predetermined force to the connection line when an upper drawer is pulled out or pushed in so as to tighten the connection line.

In one embodiment, the wire take-up unit is mounted onto the upper drawer or a cabinet of the drawer type refrigerator.

In one embodiment, the wire take-up unit comprises: a fixed part fixed on the upper drawer or the cabinet of the drawer type refrigerator; a rotation part which is fitted over the fixed part and is freely rotatable, around which a part of the connection line is wound; and a coil spring defining a first end connected to the rotation part and a second end connected to the fixed part, and compressed by the rotation part when the rotation part is rotated so as to generate a driving force for driving the rotation part.

In one embodiment, the fixed part has a center hole through which the connection line is passed.

In one embodiment, if the upper drawer door is disposed above the drawer door, the connection assembly comprises: a socket disposed on an inner side wall of a cabinet of the drawer type refrigerator and connected to the switch assembly; and a plug disposed on a side wall of an upper drawer, opposite to the socket, inserted into the socket when the upper drawer is pushed in, and connected to the lamp assembly.

In one embodiment, the switch assembly comprises: a switch disposed on an inner side wall of a cabinet of the drawer type refrigerator; and a switch touching block disposed on an outer side wall of the drawer and configured to touch the switch after the drawer is completely pushed into the drawer type refrigerator such that the lamp assembly is turned off by the switch.

With the lighting device for the drawer type refrigerator according to an embodiment of the present disclosure, a lamp assembly is disposed in a groove formed in a lower portion of an upper rotary door or an upper drawer door, such that the food in a drawer may be fully lighted.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference the accompanying drawings, in which.

DETAILED DESCRIPTION

Figure 1:
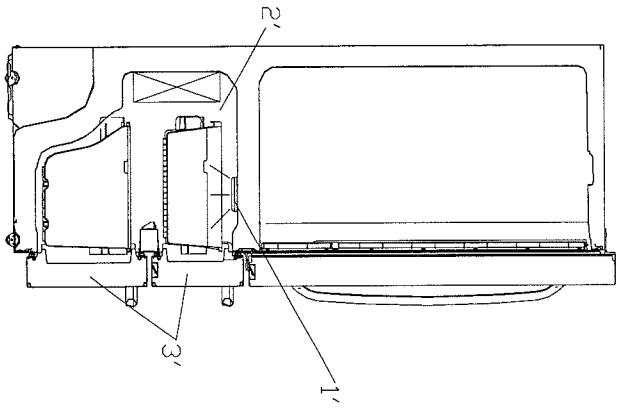
FIGS. 1-2 are schematic views of a lamp assembly in a conventional drawer type refrigerator.
Figure 2:
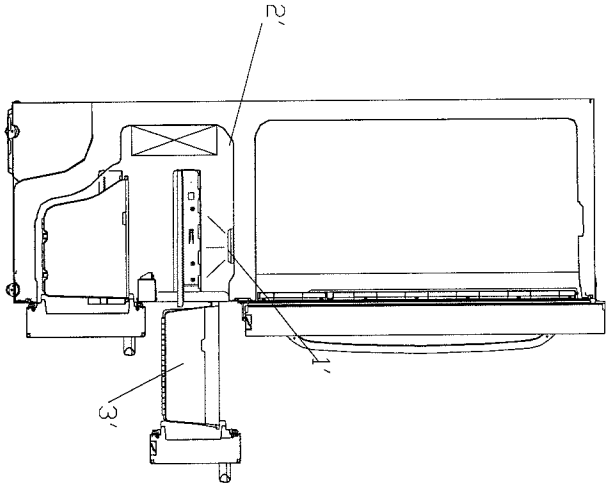

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

Figure 3:
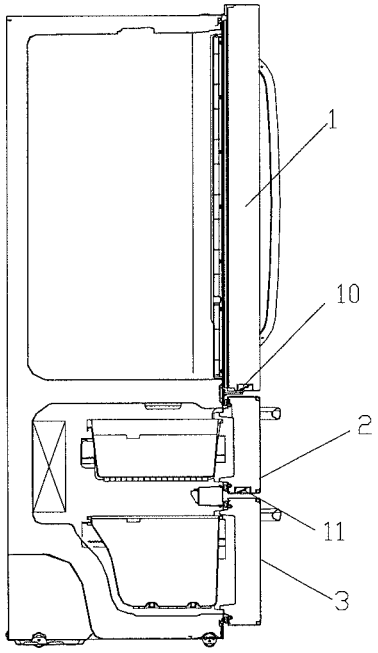
FIGS. 3-5 are schematic views showing positions of a lamp assembly in a lighting device for a drawer type refrigerator according to an embodiment of the present disclosure.
Figure 4:
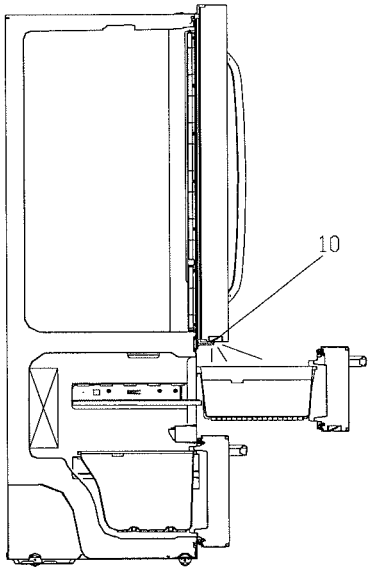
Figure 5:
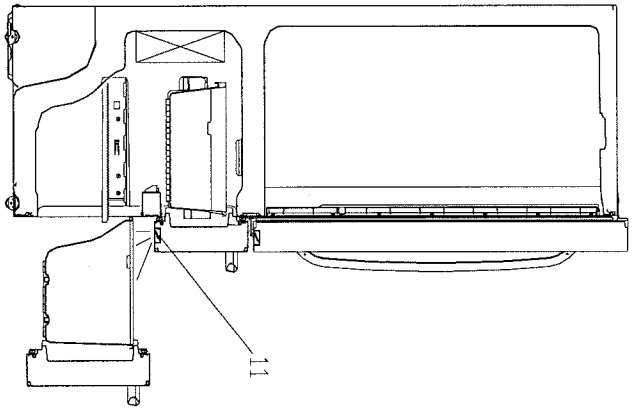

With the lighting device for the drawer type refrigerator according to embodiments of the present disclosure, a lamp assembly is disposed in a groove formed in a lower portion of an upper rotary door or an upper drawer door, such that the food in a drawer may be fully lighted. FIG. 3 is a schematic view of a lamp assembly in a lighting device for a drawer type refrigerator according to an embodiment of the present disclosure. As shown in FIG. 3, lamp assemblies 10, 11 are disposed in grooves formed in lower portions of an upper rotary door and an upper drawer door respectively, such that after an upper drawer or a lower drawer is pulled out, the upper drawer or the lower drawer may be just lighted by lights emitted by the lamp assembly 10 or 11, as shown in FIGS. 4-5. Moreover, the lights radiate onto the surface of the food may directly from the top down, thus enhancing convenience of food taking and placing. Meanwhile, human eyes may not be radiated by lights directly, only lights reflected by the food enters into human eyes, such that the harmful effect on human eyes may be avoided.

With the lighting device for the drawer type refrigerator according to embodiments of the present disclosure, a technical prejudice that a lamp assembly is only disposed in a cabinet of a refrigerator by those skilled in the art may be overcome, thus improving the lighting effect of the lamp assembly in the drawer type refrigerator.

The lighting device according to embodiments of the present disclosure applies to a drawer type refrigerator, in which the drawer type refrigerator has at least one drawer. In some embodiments, the drawer type refrigerator may have only one drawer, or may have a plurality of drawers. The drawer comprises a drawer door, and an upper rotary door or an upper drawer door is disposed above the drawer door. The lighting device for the drawer type refrigerator comprises a lamp assembly, a switch assembly, a power supply assembly configured to supply power to the switch assembly, and a connection assembly connected between the lamp assembly and the switch assembly. The lamp assembly comprises a lamp and a lamp shade of a light-transmission material and is disposed in a groove formed in a lower portion of the upper rotary door or the upper drawer door. The switch assembly is configured to control the lamp assembly to turn on or off based upon whether the drawer is pulled out.

The drawer type refrigerator shown in FIG. 3 will be described below as an example, however, it should be noted that the drawer type refrigerator shown in FIG. 3 is merely for the purpose of clarity. The drawer type refrigerator shown in FIG. 3 comprises one rotary door and two drawer doors, however, the lighting device according to an embodiment of the present disclosure may not be limited to be applied to the drawer type refrigerator shown in FIG. 3. That is, the lighting device according to an embodiment of the present disclosure may also be applied to other drawer type refrigerators (for example, a drawer type refrigerator only having one rotary door and one drawer door). As shown in FIG. 3, the drawer type refrigerator comprises a rotary door 1, and a first drawer door 2 and a second drawer door 3 disposed below the rotary door 1. Therefore, the rotary door 1 is an upper rotary door relative to the first drawer door 2, and the first drawer door 2 is an upper drawer door relative to the second drawer door 3, that is, the drawer having the first drawer door 2 is a lower drawer relative to the rotary door 1 and the drawer having the second drawer door 3 is a lower drawer relative to the first drawer door 2. A lamp assembly 10 is disposed in a groove formed in a lower portion of the rotary door 1 for lighting a first drawer, and a lamp assembly 11 is disposed in a groove formed in a lower portion of the first drawer door 2 for lighting a second drawer. In some embodiments, the rotary door 1 may be a double-acting rotary door or a single-acting rotary door.

Each of the lamp assembly 10 and the lamp assembly 11 comprises a lamp and a lamp shade of a light-transmission material.

In one embodiment, the lamp of each of the lamp assembly 10 and the lamp assembly 11 has a predetermined inclination angle so as to emit lights obliquely toward an outside of the drawer type refrigerator, thus effectively lighting a lower drawer relative to the first or second drawer, after the first drawer or the second drawer is pulled out.

In another embodiment, an outer surface of the lamp shade of the lamp assembly 10 or the lamp assembly 11 is flush with an opening of the groove in the lower portion of the rotary door 1 or the first drawer door 2, thus not affecting the appearance of the refrigerator.

In addition, it should be noted that there are no special limits to the lamp. The lamp may be a LED lamp or a common lamp bulb. Therefore, there may be a plurality of power supply modes of the lamp. The power supply may be strong electricity supplied into the refrigerator or converted weak electricity provided by a main control board. For example, if the power supply is commercial power supplied into the refrigerator and the lamp is a common lamp bulb, a switch assembly is connected between the power supply assembly and the lamp If the lamp is a LED, etc., the switch assembly comprises a detecting unit and a main control board. The detecting unit is configured to detect whether the drawer door is pulled out. The main control board is configured to control the lamp assembly 10 in the rotary door 1 or the lamp assembly 11 the first drawer door 2 based on a detecting result of the detecting unit. As shown in FIG. 3, the lamp assembly 10 and the lamp assembly 11 are each controlled by the main control board, and the main control board may be configured to convert an alternating current provided by the power supply assembly into a direct current and supply the direct current to the lamp assembly 10 and the lamp assembly 11 respectively.

Figure 6:
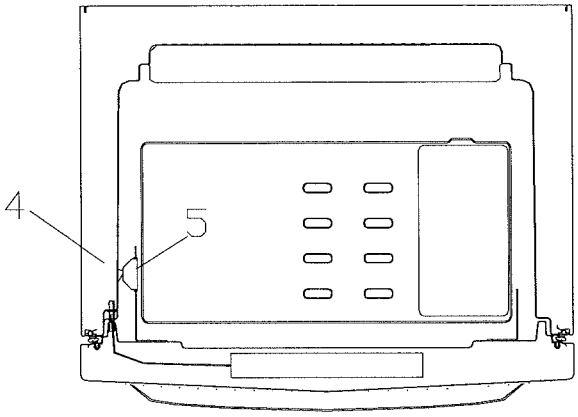
FIG. 6 is a schematic view of a switch assembly in a lighting device for a drawer type refrigerator according to an embodiment of the present disclosure.
Figure 7:
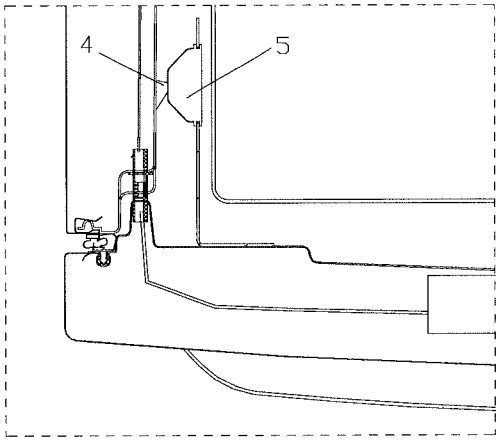
FIG. 7 is an enlarged schematic view of a switch assembly in a lighting device for a drawer type refrigerator according to an embodiment of the present disclosure.

In one embodiment, the switch assembly comprises a switch mounted on a wall of a cabinet of the drawer type refrigerator behind the lower drawer. When the lower drawer is contacted with the switch after completely pushed into the drawer type refrigerator, the lamp assembly is turned off. As shown in FIGS. 6-7, the switch assembly comprises a switch 4 disposed on an inner side wall of a cabinet of the drawer type refrigerator, and a switch touching block 5 disposed on an outer side wall of the drawer. After the drawer is completely pushed into the drawer type refrigerator, the switch touching block 5 touches the switch 4, and consequently the lamp assembly is turned off by the switch 4. After the drawer is pulled out, the switch touching block 5 is not contacted with the switch 4, the switch 4 returns to its initial state, thus controlling the lamp assembly to turn on.

In some embodiments, because the positions of the lamp assembly may be different, that is, the lamp assembly may be disposed in the lower portion of the upper rotary door or the lower portion of the upper drawer door, there are two mounting modes of the connection assembly, which will be described below respectively.

Mounting Mode 1

This mounting mode is directed to a situation that the lamp assembly is disposed in the lower portion of the upper rotary door. Because a rotation shaft of the upper rotary door may be hollow, a connection line between the switch assembly and the lamp assembly may pass through the hollow rotation shaft of the upper rotary door, thus supplying power to the switch assembly.

Mounting Mode 2

This mounting mode is directed to a situation that the lamp assembly is disposed in the lower portion of the upper drawer door. However, because the drawer needs to be pulled back and forth, there are high requirements for the connection assembly between the switch assembly and the lamp assembly. If the switch assembly is directly connected to the lamp assembly via a connection line, when the drawer is completely pulled out, the connection line is in a longest stretched state; and when the drawer is pushed in, a distance between two ends of the connection line is shortened. Due to self gravity of the connection line and small gap between the drawer and the cabinet of the drawer type refrigerator, during the movement of the drawer, the connection line may be contacted with other components so as to be wound with other components, thus causing the failure of the connection line.

In order to solve the above problems, there are provided embodiments in which the connection assembly is connected between the switch assembly and the lamp assembly.

Embodiment 1

Figure 8:
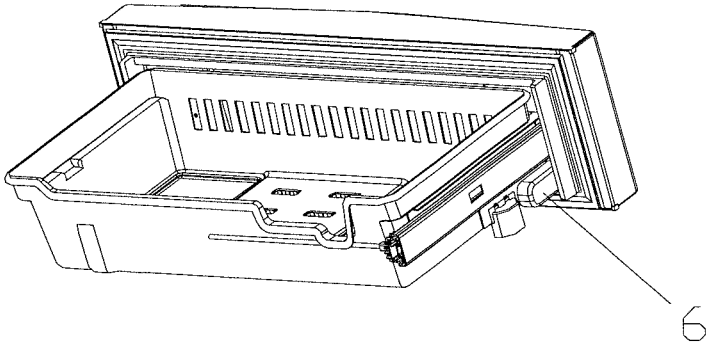
FIG. 8 is a perspective view of an upper drawer in a drawer type refrigerator according to a first embodiment of the present disclosure.
Figure 9:
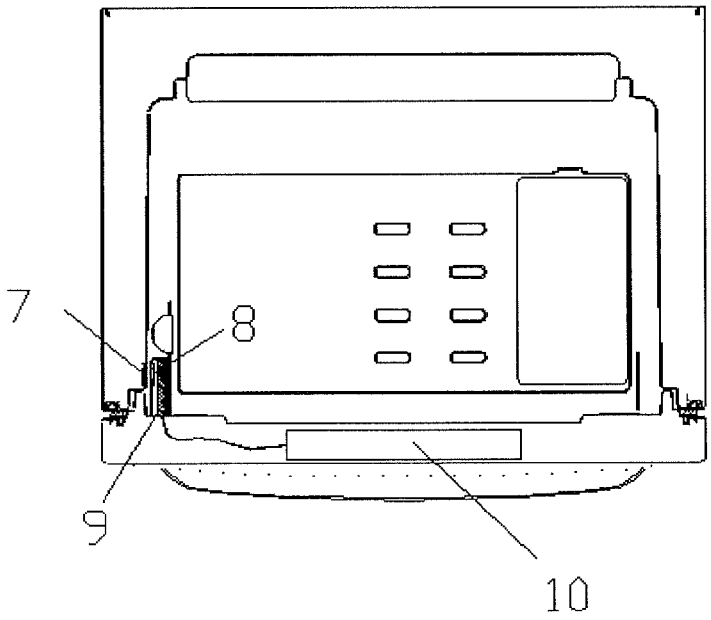
FIG. 9 is a schematic view of a connection assembly in a lighting device for a drawer type refrigerator according to a first embodiment of the present disclosure.
Figure 10:
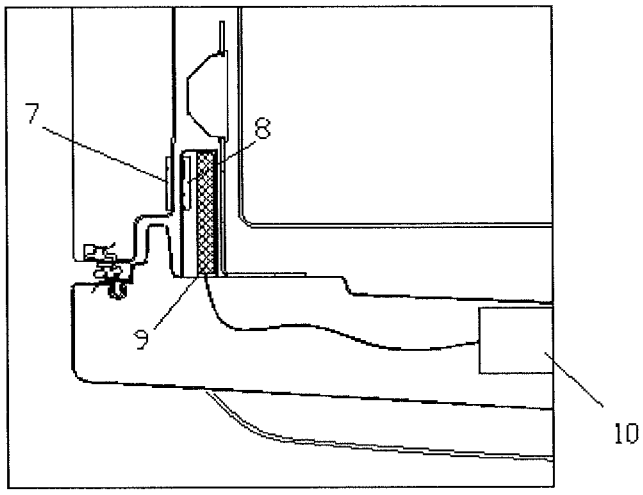
FIG. 10 is an enlarged schematic view of a connection assembly in a lighting device for a drawer type refrigerator according to a first embodiment of the present disclosure.

In this embodiment, an electromagnetic induction mode is used to solve the above problem. FIG. 8 is a perspective view of an upper drawer in a drawer type refrigerator according to a first embodiment of the present disclosure. As shown in FIG. 8, an electrical box 6 is disposed on a side wall of the upper drawer and behind the upper drawer door, thus not affecting the movement of the upper drawer door. A second coil 8 and a corresponding processing circuit 9 is disposed in the electrical box 6, and a first coil 7 is disposed on an inner side wall of a cabinet of the drawer type refrigerator and opposite to the second coil 8, such that the first coil 7 and the second coil 8 may induce each other. The first coil 7 is connected to the switch assembly, and the second coil 8 is connected to the lamp assembly via the corresponding processing circuit 9. The first coil 7 transmits electromagnetic energy, and the electromagnetic energy is induced by the second coil 8, processed by the corresponding processing circuit 9, and then supplied to the lamp assembly 10, thus supplying power to the lamp assembly 10. In one embodiment, the corresponding processing circuit 9 comprises a full-bridge rectifier circuit to convert an alternating current into a direct current and supply the direct current to the lamp assembly 10. In this embodiment, because the first coil 7 is not directly connected with the second coil 8 and each member has no moving components, thus achieving high reliability.

In this embodiment, when the upper drawer, i.e., the first drawer, is pushed in, the first coil 7 and the second coil 8 are correspondingly coupled. After the lower drawer below the upper drawer door, i.e., the second drawer, is pulled out, the first coil 7 is powered on according to a control signal provided by the switch assembly and supplies electric energy to the lamp assembly 10 by inducing the second coil 8, and then the lamp assembly starts to light. At this time, if the upper drawer is pulled out, because the lower drawer is blocked by the upper drawer, the lower drawer is not suitable for taking and placing the food. Therefore, at this time, obviously, the lower drawer does not need to be lighted. As a result, when the upper drawer is pulled out, the first coil 7 and the second coil 8 are not coupled, and at this time, the lighting of the lamp assembly 10 may be stopped.

The lighting device in this embodiment has advantages of reliable operation without moving parts, but the electric energy transmitted by electromagnetic induction may be limited, so that the cost is high for large power. However, because the LED lighting technique is very well known, he above limitations may be substantially neglected.

In some embodiments, the power supply assembly may be an industrial frequency alternating current power supply or a direct current power supply output by the main control board of the drawer type refrigerator.

Figure 11:
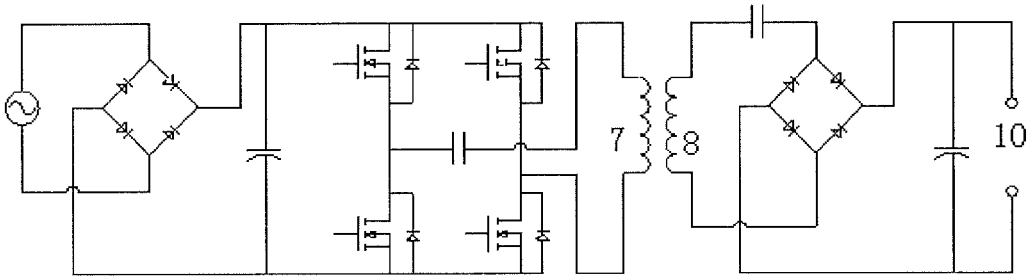
FIG. 11 is a circuit diagram of a connection assembly in a lighting device for a drawer type refrigerator according to an embodiment of the present disclosure.

FIG. 11 is a circuit diagram of a connection assembly in a lighting device for a drawer type refrigerator according to an embodiment of the present disclosure. In this embodiment, an industrial frequency alternating current is input, converted into a direct current by a first full-bridge rectifier circuit, and then converted into a high frequency alternating current by an inverter circuit. The high frequency alternating current is supplied to the first coil 7. The second coil 8 is induced by the first coil 7 and outputs the high frequency alternating current. The high frequency alternating current is converted into a direct current by a second full-bridge rectifier circuit, and then the direct current is supplied to the lamp assembly 10.

Figure 12:
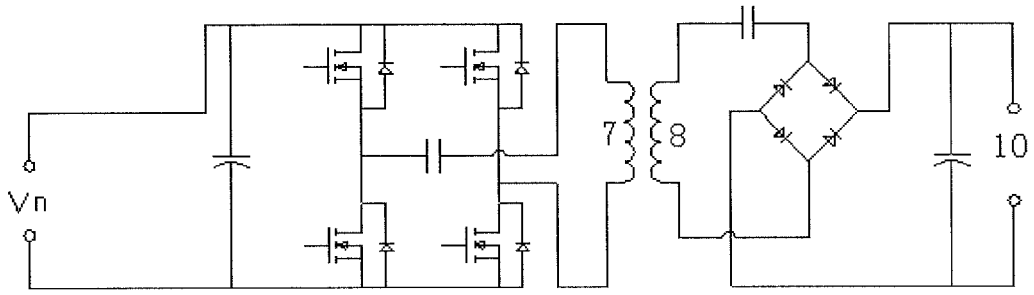
FIG. 12 is a circuit diagram of a connection assembly in a lighting device for a drawer type refrigerator according to another embodiment of the present disclosure.

FIG. 12 is a circuit diagram of a connection assembly in a lighting device for a drawer type refrigerator according to another embodiment of the present disclosure. A direct current directly output by the main control board of the drawer type refrigerator is input, and consequently the first full-bridge rectifier circuit in the above embodiment is not needed.

Embodiment 2

This embodiment is different from Embodiment 1 in that the switch assembly is directly connected with the lamp assembly via a connection line. However, in order to solve the above problem of winding due to self gravity of the connection line, a wire take-up unit is disposed. The wire take-up unit may be mounted onto the upper drawer or a cabinet of the drawer type refrigerator and around which a part of the connection line is wound. When the upper drawer is pulled out or pushed in, the wire take-up unit applies a predetermined force to the connection line so as to tighten the connection line and prevent the connection line from being wound with other components. The light device in this embodiment is achieved by a mechanical connection means, and the released length of the connection line may be freely varied by the wire take-up unit according to the movement of the drawer. Therefore, with the lighting device for the drawer type refrigerator in this embodiment, high power connection may be achieved without being affected by the state of the drawer, and the power supply assembly may supply power at any time.

Figure 13:
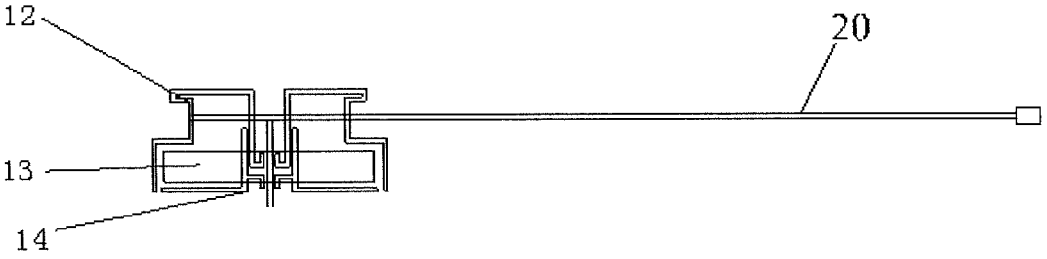
FIG. 13 is a sectional view of a wire take-up unit in a lighting device for a drawer type refrigerator according to a second embodiment of the present disclosure.
Figure 14:
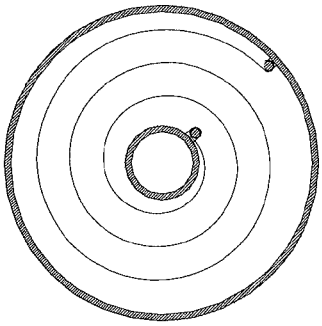
FIG. 14 is a top view of a coil spring of a wire take-up unit in a lighting device for a drawer type refrigerator according to a second embodiment of the present disclosure.
Figure 15:
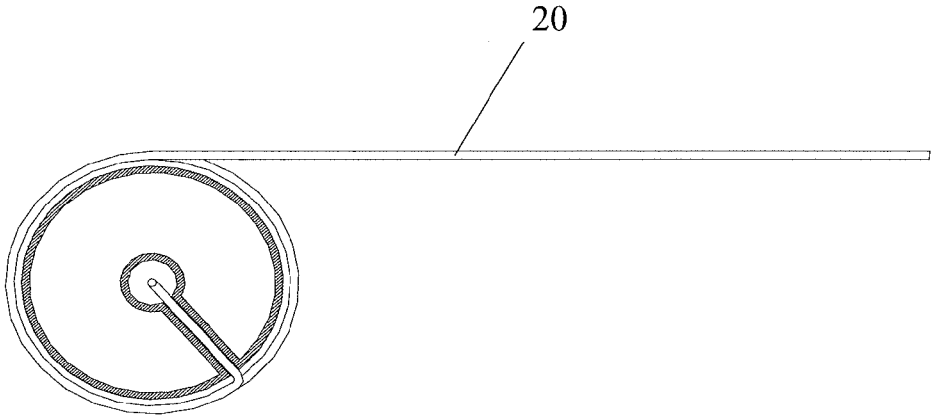
FIG. 15 is a top view of a rotation part of a wire take-up unit in a lighting device for a drawer type refrigerator according to a second embodiment of the present disclosure.

FIG. 13 is a sectional view of a wire take-up unit in a lighting device for a drawer type refrigerator according to a second embodiment of the present disclosure. As shown in FIG. 13, the wire take-up unit comprises: a fixed part 14 fixed on the upper drawer or the cabinet of the drawer type refrigerator; and a rotation part 12 which is fitted over the fixed part 14 and is freely rotatable, around which a part of the connection line 20 is wound. One end of the connection line 20 is connected to the lamp assembly, and the other end of the connection line 20 is connected to the switch assembly. The wire take-up unit further comprises: a coil spring 13 defining a first end connected to the rotation part 12 and a second end connected to the fixed part 14, and compressed by the rotation part 12 when the rotation part 12 is rotated so as to generate a driving force for driving the rotation part 12. For example, after the upper drawer is pulled out, one end of the connection line 20 moves along with the upper drawer door, the connection line 20 drives the rotation part 12 to rotate, and the rotation part 12 is rotated so as to compress and tighten the coil spring 13. At this time, because of the elasticity of the coil spring 13, the connection line 20 between the upper drawer door and the wire take-up unit is straight and tensioned. When the upper drawer door is pushed in, the distance between the upper drawer door and the wire take-up unit is shortened. At this time, because of the elastic force of the coil spring 13, the rotation part 12 is rotated so as to wind the spare connection line 20 therearound. Therefore, it may be ensured that the connection line 20 between the upper drawer door and the wire take-up unit is straight and tensioned. FIGS. 14-15 are top views of a coil spring and a rotation part of a wire take-up unit in a lighting device for a drawer type refrigerator according to a second embodiment of the present disclosure respectively. It may be seen from FIG. 14 that the first end of the coil spring 13 is connected to the rotation part 12, and the second end of the coil spring 13 is connected to the fixed part 14. It may be seen from FIG. 15 that the fixed part 14 has a center hole, a part of the connection line 20 is wound around the rotation part 12, one end of the connection line 20 is pulled out and connected to at least one electrical assembly on the upper drawer door, and the other end of the connection line 20 passes through the center hole of the fixed part 14 to be connected to a control assembly and/or the power supply assembly inside the cabinet of the drawer type refrigerator. The connection line 20 may be a power line or a control line for providing an electrical signal.

Embodiment 3

In this embodiment, the lighting device may supply power or an electrical signal to an electrical assembly on the upper drawer door by contacting a first terminal with a second terminal, and there are no moving parts, such that the lighting device may have high reliability. For example, in one embodiment, each of the first terminal and the second terminal may be a socket or a plug, thus supplying power to an electrical assembly on the upper drawer door. In this embodiment, each of the first terminal and the second terminal may be a socket or a plug. Particularly, when the first terminal is a socket, the second terminal is a plug which may be inserted into the socket; and when the second terminal is a socket, the first terminal is a plug which may be inserted into the socket.

Figure 16:
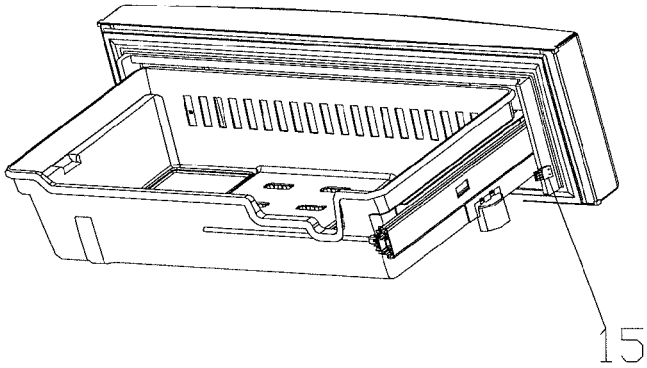
FIG. 16 is a perspective view of an upper drawer in a drawer type refrigerator according to a third embodiment of the present disclosure.
Figure 17:
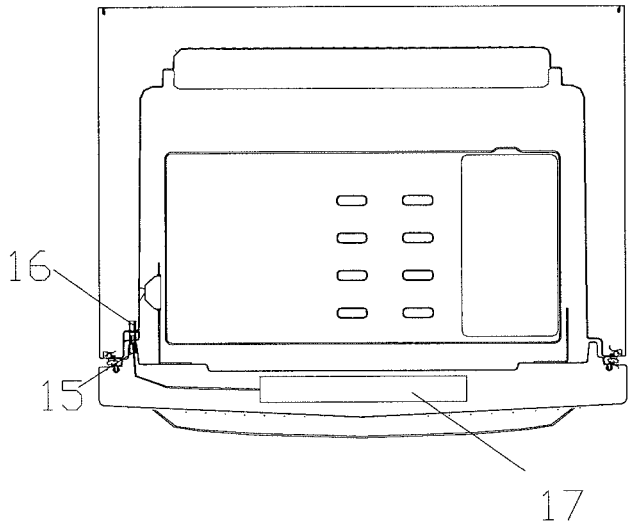
FIG. 17 is a schematic view of a connection assembly in a lighting device for a drawer type refrigerator according to a third embodiment of the present disclosure.
Figure 18:
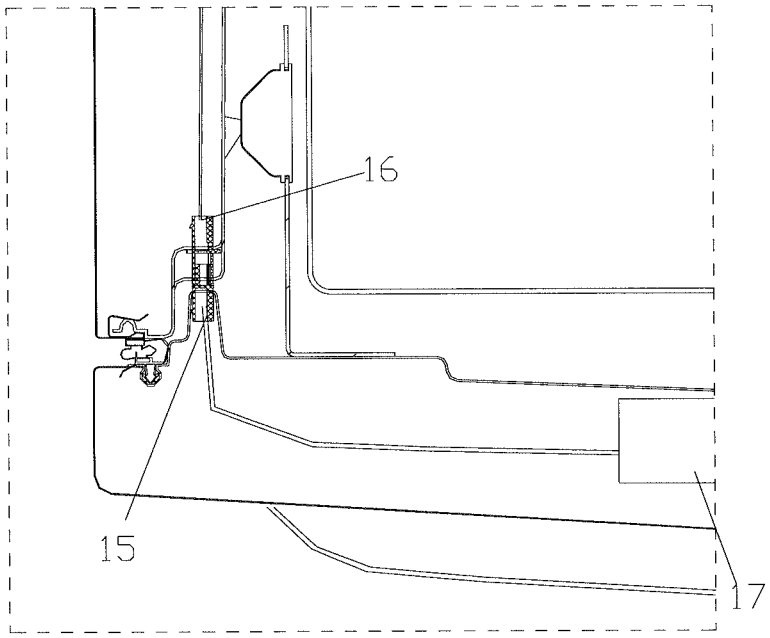
FIG. 18 is an enlarged schematic view of a connection assembly in a lighting device for a drawer type refrigerator according to a third embodiment of the present disclosure.

FIG. 16 is a perspective view of an upper drawer in a drawer type refrigerator according to a third embodiment of the present disclosure. As shown in FIG. 16, a plug 15 is disposed on an outer side wall of the upper drawer. As shown in FIGS. 17-18, the connection assembly comprises: a socket 16 disposed on an inner side wall of a cabinet of the drawer type refrigerator and connected to the switch assembly; and a plug 15 disposed on a side wall of an upper drawer, opposite to the socket 16, inserted into the socket 16 when the upper drawer is pushed in, and connected to the lamp assembly 17.

In this embodiment, the socket 16 is connected to the switch assembly. If the switch assembly comprises a main control board, the socket 16 is connected to the main control board, and a direct current in the main control board is directly supplied to the lamp assembly 17.

For a current refrigerator, because the guide rail of a drawer is mounted very finely, the problem that the plug 15 may not be inserted into the socket 16 may not appear, such that the lighting device may have high reliability.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. A drawer type refrigerator comprising:

at least two drawers, the at least two drawers comprising an upper drawer having an upper drawer door and a lower drawer having a lower drawer door;

a lamp assembly comprising a lamp and a lamp shade of a light-transmission material, and being disposed in a groove formed in a lower portion of the upper drawer door;

a switch assembly configured to control the lamp assembly based upon whether the lower drawer is pulled out;

a power supply assembly configured to supply power to the switch assembly; and a connection assembly connected between the lamp assembly and the switch assembly to supply power to the lamp assembly.

2. The drawer type refrigerator of claim 1, wherein the lamp has a predetermined inclination angle to emit light obliquely toward an outside of the drawer type refrigerator.

3. The drawer type refrigerator of claim 2, wherein an outer surface of the lamp shade is flush with an opening of the groove.

4. The drawer type refrigerator of claim 1, wherein the switch assembly comprises:

a detecting unit configured to detect whether the drawer door is pulled out; and a main control board configured to control the lamp assembly based on a detecting result of the detecting unit.

5. The drawer type refrigerator of claim 1, wherein the connection assembly comprises:

a first coil disposed on an inner side wall of a cabinet of the drawer type refrigerator and connected to the switch assembly; and a second coil disposed on a side wall of the upper drawer, opposite to the first coil, and connected to the lamp assembly.

6. The drawer type refrigerator of claim 5, wherein the connection assembly further comprises:

a first processing circuit connected to the power supply assembly and the first coil respectively, and configured to convert a current of the power supply assembly into a high-frequency alternating current; and a second processing circuit connected to the second coil and configured to convert an alternating current generated by induction of the second coil into a direct current and to supply the direct current to the lamp assembly.

7. The drawer-type refrigerator of claim 6, wherein the power supply assembly comprises an industrial frequency alternating current power supply for supplying power to the drawer type refrigerator, and the first processing circuit comprises a full-bridge rectifier circuit and an inverter circuit connected to the full-bridge rectifier circuit.

8. The drawer type refrigerator of claim 6, wherein the power supply assembly comprises a main control board for supplying a direct current, and the first processing circuit comprises an inverter circuit.

9. The drawer type refrigerator of claim 6, wherein the second processing circuit comprises a full-bridge rectifier circuit.

10. The drawer type refrigerator of claim 1, wherein the connection assembly comprises:

a connection line connected to the switch assembly and the lamp assembly respectively; and a wire take-up unit around which a part of the connection line is wound and which applies a predetermined force to the connection line when the upper drawer is pulled out or pushed in so as to tighten the connection line.

11. The drawer type refrigerator of claim 10, wherein the wire take-up unit is mounted onto the upper drawer of the drawer type refrigerator.

12. The drawer type refrigerator of claim 11, wherein the wire take-up unit comprises:

a fixed part fixed on the upper drawer of the drawer type refrigerator;

a rotation part which is fitted over the fixed part and is freely rotatable, around which a part of the connection line is wound; and a coil spring defining a first end connected to the rotation part and a second end connected to the fixed part, and compressed by the rotation part when the rotation part is rotated so as to generate a driving force for driving the rotation part.

13. The drawer type refrigerator of claim 11, wherein the fixed part has a center hole through which the connection line is passed.

14. The drawer type refrigerator of claim 1, wherein the connection assembly comprises:

a socket disposed on an inner side wall of a cabinet of the drawer type refrigerator and connected to the switch assembly; and a plug disposed on a side wall of the upper drawer, opposite to the socket, inserted into the socket when the upper drawer is pushed in, and connected to the lamp assembly.

15. The drawer type refrigerator of claim 1, wherein the switch assembly comprises:

a switch disposed on an inner side wall of a cabinet of the drawer type refrigerator; and a switch touching block disposed on an outer side wall of the drawer and configured to touch the switch after the drawer is completely pushed into the drawer type refrigerator such that the lamp assembly is turned off by the switch.

* * * * *